United States Patent [19]

Miles

[11] Patent Number: 4,603,846

[45] Date of Patent: Aug. 5, 1986

[54] DUAL-STREAM ENVELOPE FEEDER

[75] Inventor: Kevin Miles, Rncho. Cucamga, Calif.

[73] Assignees: Micheal Miles; Alfred Dubler; Rick Diebold; David Dubler, all of Ontario, Calif.

[21] Appl. No.: 657,373

[22] Filed: Oct. 3, 1984

[51] Int. Cl.[4] ..... B65H 9/04

[52] U.S. Cl. ..... 271/2; 271/9; 271/240; 271/250; 271/221

[58] Field of Search ..... 271/240, 250, 9, 2, 271/221

[56] References Cited

U.S. PATENT DOCUMENTS

| | | | |
|---|---|---|---|
| 3,375,003 | 3/1968 | Godlewski | 271/9 |
| 3,871,644 | 3/1975 | Stobb | 271/250 X |
| 3,893,664 | 7/1975 | Thomsen | 271/100 |
| 3,934,868 | 1/1976 | Selak | 271/9 |
| 4,228,994 | 7/1979 | Volpe | 271/250 |
| 4,348,125 | 9/1982 | Fujiwara | 271/240 X |

OTHER PUBLICATIONS

Installation and Operating Instructions C-2000-A Envelope Feeder, p. 6, Press Specialties, Portland, Oreg.

Cheif 215 & 217 Operator Manual 1978, pp. 3-5,6, 5-10, Plate 10 ATF-Davidson, Whitinsville, Mass.

*Primary Examiner*—Richard A. Schacher
*Attorney, Agent, or Firm*—Sheldon & Mak

[57] ABSTRACT

A dual-stream envelope feeding attachment for a sheet feeding printing press comprising a register bar centrally located in the feed path of the press between oppositely reciprocating joggers moving the envelopes into lateral registration against opposite sides of the register bar. The register bar can be assembled in a removable unit with a pair of oppositely disposed sheet riders urging the fed envelopes into contact with conveyor means on the press proximate to opposite sides of the register bar. A separator plate, having a thickness greater than the lateral width of the register bar, is mounted in alignment with the register bar on a stack feeder for initially positioning pairs of envelopes on the conveyor laterally separated from the register bar in preparation for registration thereto by the joggers. A press conveyor section having a pair of adjustably located conveyor tapes and another conveyor tape centrally located therebetween by a scissors mechanism, a pair of central conveyor tapes being substituted symmetrically at opposite sides of the register bar.

11 Claims, 5 Drawing Figures

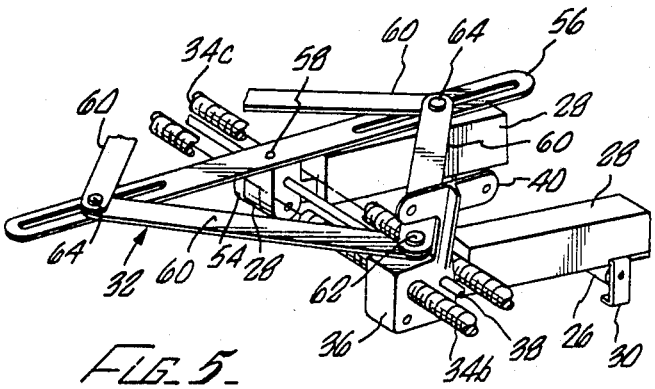
FIG. 5.
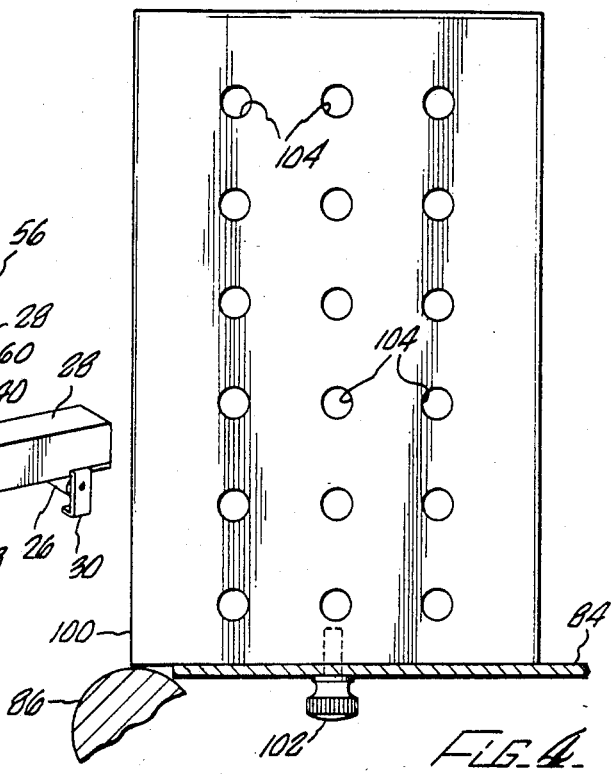
FIG. 4.
FIG. 2.
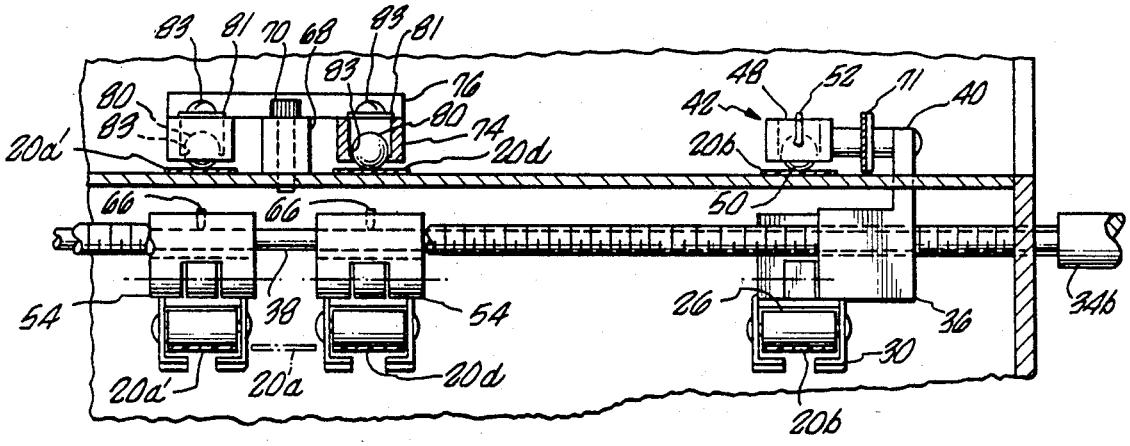
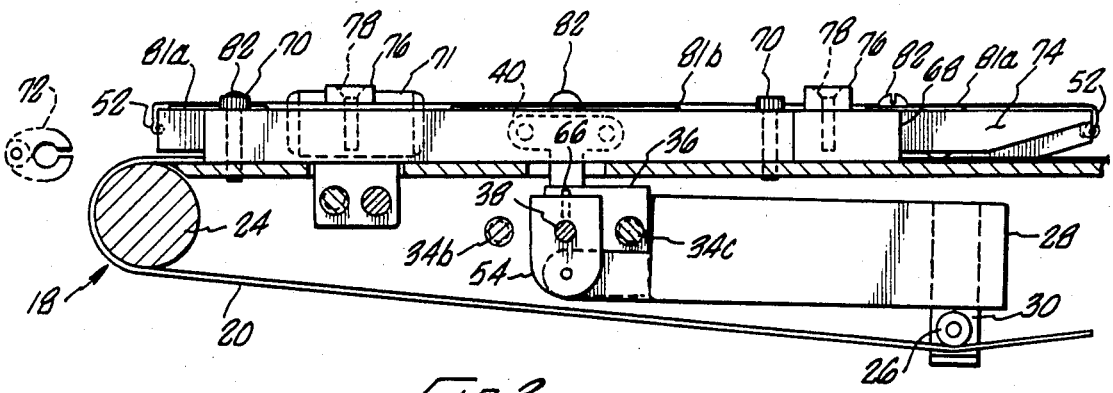
FIG. 3.

DUAL-STREAM ENVELOPE FEEDER

BACKGROUND

This invention relates to sheet feeding apparatus for printing presses such as offset or letter presses, and more particularly to a dual-stream envelope feeding printing press attachment.

Sheet feeding and registration devices for printing envelopes typically include means for separating one sheet at a time from a stack of sheets, the sheets being fed serially to a conveyor for longitudinal and lateral registration, the sheets being subsequently gripped and drawn through a printing station of the press.

When printing narrow stock such as envelopes, it is advantageous to feed and print two at a time for effective utilization of the press. This is because the cost of operating the press is directly related to the number of printing cycles performed, only incidentally influenced by the total width of stock printed in a cycle.

In U.S. Pat. No. 3,893,664, a feeding attachment for use on a Multilith press is described. Envelopes are separated from the bottom of a stack and transported by vacuum suckers to a feed roller for delivery to a conveyor on the press. A pair of adjustable side guides and an adjustable back guide hold the stack in position against a stationary stop plate. A jogger paddle at one side of the conveyor moves the envelopes into lateral registration against an opposite stationary paddle. In a commercial version of the attachment, available from Press Specialties Mfg. Co., Portland, Oreg., a "2-up" accessory can be added for feeding two streams of envelopes. The accessory includes a double guide for use between the two stacks of envelopes, an additional back guide for use behind one of the stacks, a pair of secondary joggers, and a pair of secondary sheet riders. The secondary joggers are mounted, one to a stationary shaft, the other to a jogging shaft between a centermost pair of four conveyor tapes in the conveyor section of the Multilith press. Two standard sheet riders, and the secondary sheet riders are positioned, each over one of the four conveyor tapes for urging each envelope into contact with two of the conveyor tapes. As the envelopes move along the conveyor, the envelopes of each pair are jogged simultaneously in the same direction by the jogger paddles on the jogging shaft toward the corresponding stationary jogger paddles on the stationary shaft. Each pair of envelopes is subsequently printed as described above.

A disadvantage of this prior art attachment for dual-stream feeding is that it is difficult to set up. Installation and adjustment of the individual secondary joggers and secondary sheet riders is difficult, time consuming, and therefore expensive. Removal of at least the secondary joggers is also required prior to resumption of single-stream operation.

Another disadvantage of this prior art attachment for dual-stream feeding is that proper registration with the printing station is difficult to obtain. Two separate lateral adjustments are required for each stream on the conveyor, the streams required to be spaced apart a fixed distance as determined by image spacing at the printing station.

Another disadvantage of this prior art attachment for dual-stream feeding is that the secondary jogger paddles use up an excessive amount of space in the center of the press. Clearance must be provided between the laterally moving paddle mounted to the jogging shaft and another paddle on the stationary shaft. This wasted space results in dual-stream operation being limited to narrower envelopes than would otherwise be possible.

A further disadvantage of this prior art attachment is that envelopes tend to become caught between stack guides on the attachment when envelopes near the bottom of the stack have air squeezed therefrom by the weight of envelopes higher in the stack.

In U.S. Pat. No. 4,228,994, a variable jogger for lateral registration of fed sheets with respect to the center line of a printing press is described. Joggers at each side of a conveyor section of the press simultaneously move fed sheets toward the center line. Separate lateral adjustments of each jogger can be made while the press is operating. A disengagement mechanism permits separate use of either paddle. Commercial versions of the press, produced by the patent assignee, are commonly known as the Chief 15, 17, 215, and 217 Duplicators. The conveyor section of the Chief press is equipped with three conveyor tapes. Two of the conveyor tapes, and corresponding sheet riders, are adjustably positioned near opposite sides of the path of the fed sheets. The third conveyor tape is located midway between the others by a scissors mechanism coupled to the corresponding outside conveyor tape adjustment means. The patent describes dual-stream feeding with the joggers contacting one side only of the fed sheets. A version of the prior art feeding attachment described above can be used on the Chief press; however, successful dual-stream envelope feeding thereon has heretofore not been achieved. It is believed that one or more of the following problems have contributed to the lack of successful dual-stream envelope feeding on the Chief press:

1. Three conveyor tapes. For proper angular alignment of the fed sheets on the conveyor section, each sheet should be supported near opposite sides thereof by conveyor tapes and held in balanced contact therewith by corresponding sheet riders. A sheet rider like those associated with the outside conveyor tapes could be positioned over the middle conveyor tape; however, there is room for only one such sheet rider, contacting only one stream of the sheets. Therefore, unbalanced conveyor contact and angular misalignment of the sheets results from dual stream feeding over only the three conveyor tapes.

2. Single edge registration. In dual stream feeding, no stationary jogger paddle is provided on the Chief press. Consequently, envelopes tend to twist laterally out of position when jogged at one edge only, because irregular drag is produced by contact between the sheet riders and folds of the envelope.

3. Scissors mechanism. Lateral adjustment of an outside conveyor tape produces a corresponding centering lateral movement of the middle conveyor tape. Consequently, there is an interaction in the relationship of the conveyor tapes to the envelopes fed on opposite sides of the press. Additionally, the center conveyor tape cannot be positioned for equal contact with unequally sized envelopes fed on opposite sides of the press.

Accordingly, there is a requirement for a dual-stream envelope feeding printing press attachment that is easy to set up and adjust, is easy to restore to single-stream operation, provides a fixed registration distance between corresponding pairs of envelopes, does not jam when feeding envelopes, and is economical to produce.

SUMMARY

The present invention is directed to a dual-stream envelope feeder that satisfies this need. The feeder was developed by adapting a Chief press equipped with a Press Specialties feeding attachment to permit successful dual-stream feeding of envelopes. The feeder comprises a register bar having opposite, parallel sides defining lateral separation of two streams of envelopes, the register bar being fixed to the press between oppositely driven joggers on the press. The joggers move corresponding envelopes laterally into contact with opposite sides of the register bar, positioning the envelopes in registration at a fixed spacing defined by the width of the register bar. The spacing between impressions made at a printing station on the press can be conveniently predetermined according to the width of the register bar.

Preferably the register bar supports a pair of sheet riders for urging the corresponding fed sheets into engagement with conveyor tapes of the press located at each side of the register bar. The pair of sheet riders and the register bar are conveniently provided in a unit that can be installed on the press for dual-stream operation and removed for single-stream operation. Thus the sheet riders advantageously remain in alignment with the register bar at all times.

Preferably a plate for separating two stacks of envelopes is provided on a mechanism for feeding the envelopes individually from the stacks to the conveyor section of the press. Preferably the plate is located in line with the register bar, the plate having a thickness greater than the distance between opposite sides of the register bar for positioning the envelopes laterally away from the opposite sides of the register bar for permitting the lateral movement by the corresponding joggers.

Preferably the plate is provided with vent holes between opposite sides of the plate for maintaining the stacks of envelopes in a fluffed up condition during feeding to prevent jamming of the stacked envelopes.

In one version of the present invention, a method for converting a Chief press is provided wherein a scissors mechanism locating a center conveyor tape of the press is removed, the center conveyor tape being moved to one side of a feed path centerline of the press and clamped in a fixed position. Another conveyor tape and associated hardware is added to the press at a corresponding opposite fixed location. The press, thus equipped with four conveyor tapes, can advance two streams of envelopes, each riding on its own pair of conveyor tapes. A register bar is installed on the press between the centermost pair of conveyor tapes, the register bar defining separation of corresponding pairs of envelopes contacting opposite sides of the register bar. A plate for spacing stacks of envelopes apart on a feed mechanism is installed in line with the register bar for separating the stacks of envelopes by a distance greater than the thickness of the register plate for permitting joggers on the press to move pairs of fed envelopes laterally into registration against opposite sides of the register bar.

Preferably a pair of sheet riders is provided in an assembly with the register bar, the sheet riders being assembled in proper alignment parallel to the register bar. Thus convenient conversion to and from dual-stream opeation is provided by simply installing and removing the assembled sheet riders and register bar.

Preferably the distance between opposite sides of the register bar is greater than the width of a centrally located gripper finger of a plurality of gripper fingers of the press receiving the fed envelopes, for preventing contact between the central gripper finger and any of the fed envelopes for insuring that registration is not disturbed by the central gripper finger attempting to engage one or both envelopes of a fed pair.

This method is the first successful conversion to dual-stream envelope feeding on the Chief press. The use of standard press components and a very few easy to produce additional parts enables low-cost conversion of this popular press.

Thus a dual-stream envelope feeder is provided that is easy to set up and adjust, is easy to restore to single-stream operation, provides a fixed registration distance between corresponding pairs of envelopes, does not jam when feeding envelopes, and is economical to produce.

DRAWINGS

These and other features, aspects, and advantages of the present invention will become better understood with reference to the following description, appended claims, and accompanying drawings where:

FIG. 2 is a fragmentary lateral elevational sectional view of the feeder of FIG. 1, taken along line 2—2 in FIG. 1;

FIG. 3 is a fragmentary longitudinal elevational sectional view of the feeder of FIG. 1 taken along line 3—3 in FIG. 1;

FIG. 4 is a fragmentary longitudinal elevational sectional view of the feeder of FIG. 1 taken along line 4—4 in FIG. 1; and FIG. 5 is a lateral elevational front perspective view of a scissors mechanism for laterally locating a central conveyor tape of a Chief press.

DESCRIPTION

Figure 1:
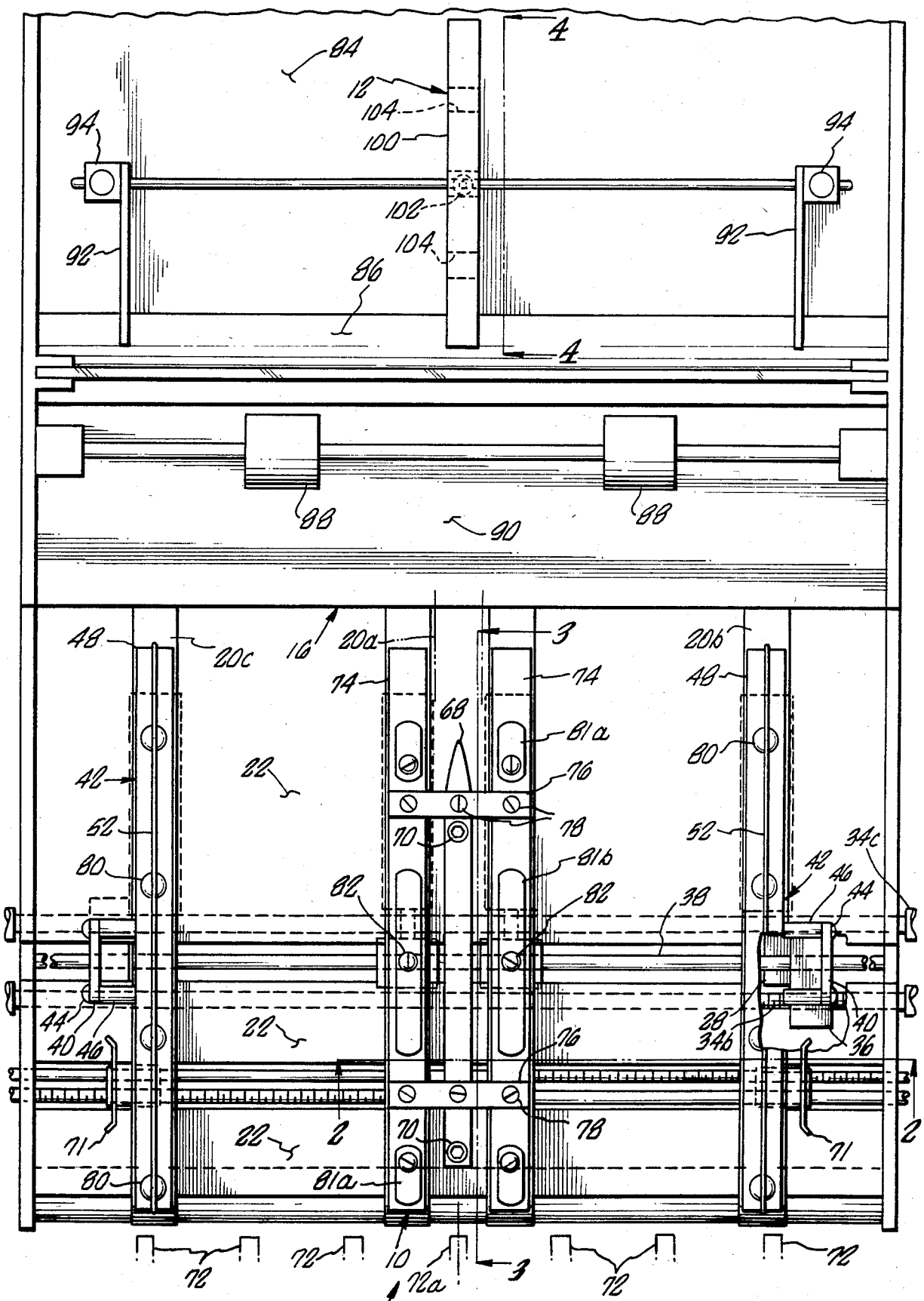
FIG. 1 is a fragmentary plan view of a printing press equipped with a dual-stream feeder according to the present invention.

The present invention is directed to a dual-stream envelope feeding printing press attachment. The attachment includes a conveyor modification, a guide unit 10, and a stack separator 12.

Conveyor Modification

With reference to FIGS. 1-5, a sheet feeding printing press 14 is equipped with a feeder assembly 16 for serial delivery of sheets to a conveyor section 18 on the press.

The conveyor section 18 includes a plurality of conveyor tapes 20 for transporting the sheets over a register board 22 for registration of the sheets in preparation for a subsequent printing operation. The conveyor tapes 20 engage a conveyor roller 24, and an additional roller, not shown. Each of the conveyor tapes 20 is tensioned by a tension roller 26, the tension roller 26 being loaded by a weight 28, and rotatably mounted thereto by a pair of roller brackets 30, the roller brackets 30 providing lateral guidance for the corresponding conveyor tape 20.

With reference to FIG. 5, the feeder of the present invention was developed on a Chief press, the press having a scissors mechanism 32 for centering one of the conveyor tapes, designated **20*a* in FIG. 1, midway between opposite conveyor tapes designated 20*b* and 20*c*. The conveyor tapes 20*b* and 20*c* are positioned by corresponding tape screws 34*b* and 34*c*, each engaging a hanger block 36, from which the corresponding weight 28 is pivotally mounted. Each hanger block 36 also slidably engages a hanger rod 38 for rotational alignment. Each hanger block 36 includes a rider support 40 for mounting a respective press rider assembly 42. Each press rider assembly 42, fastened to the corresponding rider support 40 by a pair of mounting screws 44 and corresponding hanger spacers 46, includes a press rider bar 48, guiding a plurality of press rider balls 50, the press rider balls 50 being retained within the press rider bar 48 by a retainer wire 52. The press rider assemblies 42 are thus maintained in alignment over the respective conveyor tapes 20***b* and 20*c* during lateral adjustment of the conveyor tapes 20*b* and 20*c* by the respective tape screws 34*b* and 34*c*. A weight block 54, slidably engaging the hanger rod 38, laterally locates the conveyor tape 20*a*, a corresponding weight 28 being pivotably mounted thereon. The weight block 54 is laterally positioned by a longitudinally slotted scissors bar 56 engaging a scissors pin 58 vertically extending from the weight block 54. Two pair of scissors links 60, pivotally fastened at one end thereof to a respective hanger block 36 by a scissors pin 62, are pivotally joined together at opposite ends thereof by a pair of slide pins 64, the slide pins 64 also engaging the scissors bar 56 for positioning the scissors bar 56, and thereby the conveyor tape 20*a*, midway between the hanger blocks 36.

In order to permit dual-stream envelope feeding according to the present invention, the scissors bar 56, the scissors pin 58, the scissors links 60, the scissors pins 62, and the slide pins 64 are removed and discarded. A set screw 66 is installed in the weight block 54 in place of the scissors pin 58. The weight block 54 is relocated on the hanger rod 38 for repositioning the conveyor tape 20*a* to a new location, designated 20*a*', the weight block 54 being clamped to the hanger rod 38 by the set screw 66.

An additional one of the conveyor tapes 20, tension rollers 26, weights 28, pair of roller brackets 30, and weight blocks 54 is installed opposite the conveyor tape 20*a*' in position 20*d* in FIG. 2 and clamped in position on the hanger rod 38 by an additional set screw 66. Thus the press is provided with a total of four of the conveyor tapes 20 for transporting pairs of fed envelopes on two each of the conveyor tapes 20.

Guide Unit 10

The guide unit 10 includes a register bar 68 that is attached to the register board 22 by a pair of register screws 70. The register bar 68 provides a fixed lateral registration location for two streams of envelopes while cooperating with a pair of opposite jogger paddles 71 to prevent twisting of the envelopes.

A plurality of gripper fingers 72, a central one being designated 72*a*, receive registered fed sheets from the conveyor section 18, pulling the sheets over printing means within the printing press 14, not shown.

Preferably the register bar 68 is wider than, and mounted in line with, the central gripper fingers 72*a*. This location of the register bar 68 advantageously prevents engagement of a fed envelope from either side of the register bar 68 with the central gripper fingers 72*a*, possibly interfering with smooth engagement of fed envelopes that would result if two of the envelopes were clamped by a single one of the gripper fingers 72.

Preferably a pair of attachment rider bars 74 is mounted at opposite sides of the register bar 68 on a transverse pair of hanger bars 76, and fastened thereto by a plurality of hanger screws 78. The attachment rider bars 74 are located in alignment over the corresponding conveyor tapes 20*a*' and 20*d*, each attachment rider bar 74 horizontally locating a plurality of attachment rider balls 80 for urging fed sheets into contact with the respective conveyor tapes 20*a*' and 20*d* similarly to the previously described press rider assemblies 42. The attachment rider balls 80 are retained within the attachment rider bars 74 by corresponding retainer tabs 81, designated 81*a* and 81*b*, the retainer tabs 81*a* retaining one attachment rider ball 80 each, the retainer tabs 81*b* each retaining a pair of the attachment rider balls 80. The retainer tabs 81 are fastened to top surfaces of the attachment rider bars 74 by corresponding tab screws 82. Thus the attachment rider balls 80 are held in place without interfering with mounting of the hanger bars 76 on the attachment rider bars 74.

Preferably, in order to prevent loss of the attachment rider balls 80 when the register bar 68 is removed from the printing press 14, a retaining shoulder 84 is provided in the attachment rider bar 74 under each of the rider balls 80.

Thus the guide unit 10, including the register bar 68, the attachment rider bars 74, complete with the attachment rider balls 80, can be installed or removed from the press without disturbing alignment of the attachment rider bars 74 and without risking loss of the attachment rider balls 80.

Feeder Assembly 16

With reference to FIGS. 1 and 4, the feeder assembly 16 can comprise a separate commercially available attachment as described above. The feeder assembly 16 includes a feed table 84 for supporting stacks of stock to be fed to the press. A separating mechanism, not shown, advances sheets one at a time over a feed roller 86 to a pinch roller 88, down a ramp 90 to the conveyor section 18 of the printing press 14.

A pair of side guides 92 can be positioned on the feed table 84 and clamped in position by a pair of clamp screws 94, the clamp screws 94 passing through a slot 96 in the feed table 84 and engaging corresponding clamp nuts 98 under the slot 96.

The stack separator 12 includes a separator plate 100, positioned between the side guides 92 on the feed table 84, and held in place by a separator screw 102, the separator screw 102 passing through the slot 96 from beneath the feed table 84.

The separator plate 100 has a thickness greater than the width of the register bar 68 and is clamped to the feed table 84 in alignment thereto for positioning two streams of envelopes on the conveyor section 18, separated beyond opposite sides of the register bar 68. For example, the thickness of the separator plate 100 can be $\frac{1}{8}$ of an inch greater than the width of the register bar 68. When the separator plate 100 is positioned on the feed table 84 in alignment with the register bar 68, stacks of envelopes positioned against opposite sides thereof will proceed onto the conveyor section 18 positioned laterally approximately 1/16 of an inch from opposite sides of the register bar 68. As the envelopes travel along side the register bar 68, the jogger paddles 71 can translate the respective envelopes into contact with the register bar 68, accurately laterally registering the envelopes in a fixed relation to the printing means within the printing press 14.

Preferably the separator plate 100 is provided with a multiplicity of vent holes 104 connecting opposite sides thereof for preventing envelopes stacked between the separator plate and corresponding side guides 92 from becoming jammed therebetween during feeding. It has been discovered that the vent holes 104 act to keep stacked envelopes in a "fluffed up" condition that facilitates smooth passage of the envelopes from the feeder assembly 16.

Thus the feeder assembly 16, preferably equipped with the stack separator 12 described herein, effectively operates in combination with the guide unit 10 on a Chief press having the conveyor modification described above, accurately and effeciently feeding two streams of envelopes to the press.

Although the present invention has been described in considerable detail with regard to certain versions thereof, other versions are possible. For example, the guide unit 10 can be installed on a Multilith press, the multilith press being modified to include movable joggers at both sides of the guide unit 10, no conveyor modification being required. Therefore, the spirit and scope of the appended claims should not necessary be limited to the description of the versions contained herein.

What is claimed is:

1. A dual-stream feeder for a sheet feeding printing press, the press having a conveyor section receiving separate sheets from stack feeding means and opposed reciprocating jogging means at opposite sides of the conveyor section for lateral movement of the sheets from opposite sides toward a register path over a register board on the conveyor section, the feeder comprising:

(a) register means for defining a laterally fixed spacing between two streams of the sheets, the register means comprising an elongated member having opposite parallel sides separated by the fixed spacing; and (b) means for fastening the register means to the register board between the joggers, wherein the jogging means can move corresponding sheets laterally into contact with the sides of the register means, positioning the sheets in lateral registration at the fixed spacing.

2. The feeder of claim 1 including a pair of oppositely disposed sheet riders mounted parallel to the register means for urging the corresponding sheets into engagement with the conveyor section of the press at locations proximate to, and at opposite sides of, the register means.

3. The feeder of claim 2 wherein the sheet riders are joined in a single structure with the register means for convenient removal and replacement of the sheet riders and the register means without disturbing a relative alignment therebetween.

4. The feeder of claim 1 including a separator plate on the stack feeding means, the separator plate being located in lateral alignment with the register means, and having a thickness greater than the fixed spacing for introducing the sheets to the conveyor section laterally separated from the opposite sides of the register means for controlling the lateral movement of the sheets required by the joggers to bring the sheets into contact with the opposite sides of the register means.

5. The feeder of claim 4 wherein the separator plate is vented between opposite sides thereof for maintaining stacks of envelopes in a fluffed up condition during feeding for preventing jamming of the envelopes in the stack feeder.

6. The feeder of claim 5 wherein the venting includes a plurality of cylindrical passages connecting opposite sides of the separator plate.

7. A dual-stream feeder in combination with a sheet feeding printing press, the press having a conveyor section receiving separate sheets from stack feeding means and opposed reciprocating jogging means at opposite sides of the conveyor section for lateral movement of the sheets from opposite sides toward a register path over a register board on the conveyor section, the feeder comprising:

(a) register means for defining a laterally fixed spacing between two streams of the sheets, the register means comprising an elongated member having opposite parallel sides separated by the fixed spacing; and (b) means for fastening the register means to the register board between the joggers, wherein the jogging means can move corresponding sheets laterally into contact with the sides of the register means, positioning the sheets in lateral registration at the fixed spacing.

8. A method for converting a sheet feeding printing press for dual-stream feeding of envelopes, the press having a scissors mechanism locating a first center conveyor tape mechanism of a conveyor section of the press laterally centered between adjustably located outside conveyor tapes, the method comprising the steps of:

(a) disconnecting the scissors mechanism;

(b) securing the first center conveyor tape mechanism in a fixed position to one side of a feed path center line of the press;

(c) providing a second center conveyor tape mechanism for the press;

(d) securing the second center conveyor tape mechanism positoned opposite the feed path centerline from the first center conveyor tape mechanism;

(e) providing a register bar for defining lateral registration of two streams of envelopes;

(f) attaching the register bar to the press between the first and second center conveyor tape mechanisms;

(g) providing a separator plate for spacing stacks of envelopes apart on the stack feeder;

(h) installing the separator plate on the stack feeder in lateral alignment with the register bar for introducing fed envelopes to the conveyor section positioned laterally away from opposite sides of the register bar for permitting joggers on the press to move pairs of fed envelopes laterally into regisration against opposite sides of the register bar.

9. The method of claim 8 comprising the additional steps of:

(a) providing a pair of sheet riders for urging the fed envelopes into contact with the first and second center conveyor tapes;

(b) assembling the sheet riders in a structure removable with the register bar; and (c) aligning the sheet riders parallel to the register bar for locating the sheet riders centered over the respective first and second center conveyor tapes.

10. The method of claim 8 wherein the step of providing the register bar comprises an additional step of providing a distance between opposite sides of the register bar greater than a corresponding distance on a centrally located one of a plurality of gripper fingers on the press; and the step of installing the register bar on the press includes a further step of aligning the register bar with the centrally located gripper finger for preventing contact between the centrally located gripper finger and any of the fed envelopes for insuring that registration of the envelopes is not disturbed by engagement of the central gripper finger with one or both envelopes of a fed pair.

11. A method for converting a sheet feeding printing press for dual-stream feeding of envelopes, the press having a conveyor section receiving sheets from stack feeding means on the press, opposed reciprocating jogging means at opposite sides of the conveyor section for lateral movement of fed sheets from opposite sides toward a register path over a register board on the conveyor section, the method comprising the steps of:

(a) selecting a register bar having a width for defining lateral separation of two streams of the sheets;

(b) mounting the register bar to the register board between the jogging means so that the jogging means can move pairs of the fed sheets into registration against opposite sides of the register bar, separated by the width of the register bar;

(c) providing a separator plate for spacing stacks of envelopes apart on the stack feeder; and (d) installing the separator plate on the stack feeder in lateral alignment with the register bar for introducing fed envelopes to the conveyor section positioned laterally away from opposite sides of the register bar for permitting joggers on the press to move pairs of fed envelopes laterally into registration against opposite sides of the register bar.

* * * * *